United States Patent [19]

Betts

[11] Patent Number: 4,622,792

[45] Date of Patent: Nov. 18, 1986

[54] MODULAR DECK STRUCTURE AND METHOD FOR CONSTRUCTING SAME

[75] Inventor: Daniel L. Betts, Lorton, Va.

[73] Assignee: Champion Building Systems, Inc., Lorton, Va.

[21] Appl. No.: 800,049

[22] Filed: Nov. 19, 1985

Related U.S. Application Data

[63] Continuation-in-part of Ser. No. 615,743, May 31, 1984, abandoned.

[51] Int. Cl.[4] ..... E04B 1/00

[52] U.S. Cl. ..... 52/263; 52/488; 52/777; 52/299

[58] Field of Search ..... 52/483, 488, 263, 777, 52/778, 299, 741, 480

[56] References Cited

U.S. PATENT DOCUMENTS 1,493,470 5/1924 Cash .
2,883,711 4/1959 Kump .
4,344,262 8/1982 Berman et al. .

OTHER PUBLICATIONS

*Deck & Patio Projects You Can Build,* Better Homes & Gardens, p. 42.

*Sweet's Catalog File,* 1979, Silver Metal Products Inc., 5-79, p. 21.

*Primary Examiner*—Carl D. Friedman

*Attorney, Agent, or Firm*—Hall, Myers & Rose

[57] ABSTRACT

A modular deck structure comprises a plurality of rectangular flooring platforms; joists that intersect in criss-cross fashion to form a plurality of rectangular frames; and planks coupled to extend along the interior surface of at least two joists of each rectangular frame; each rectangular frame and the planks coupled thereto are dimensioned to enable at least one of the platforms to be seated within a corresponding frame and to be supported by the planks coupled thereto; wherein some of the joists have at least one end with a notch thereon-which may be reinforced; and wherein pairs of joists are joined at respective intersection points thereof by positioning a notched end of a second criss-crossing joist on the plank along a first criss-crossing joist, the second joist being supported at one end by the plank of said first criss-crossing joist where the entire deck may be supported above ground by ground posts. The invention also relates to a method of constructing the deck.

20 Claims, 7 Drawing Figures

MODULAR DECK STRUCTURE AND METHOD FOR CONSTRUCTING SAME

PROSECUTION HISTORY

This is a continuation-in-part application of Ser. No. 615,743, filed May 31, 1984 now abandoned.

BACKGROUND OF THE INVENTION

Exterior decks and similar outdoor wood platform structures are becoming ever more popular additions to houses. The value of such decking rests in enlargement of usable space for entertaining, etc., as well as enhancing the quality of outdoor activities such as cookouts or relaxation. Decking and its construction, like most residential construction, is subject to a multitude of variances in the nature of its size, placement, materials employed, etc. Also, the climate and temperatures to which the decking is exposed not only governs aspects of construction, due to expansion and contraction, but also of materials employed.

Referring to construction methods, currently the dominant method is commonly known as "stick built". This method entails a contractor going to the site, and constructing a deck the dimensions and configuration of which are unique to that site. Obviously, as a result, the majority of decks extant and currently under construction in the United States are non-uniform. Tolerances and crafting will differ from site-to-site as well as from worker-to-worker. Although certain construction standards exist, most notably those promulgated by BOCA, Building Official Code Administrators, it is difficult if not impossible to inspect each deck constructed to assure compliance with and adherence to those standards. Additionally, regional jurisdictions maintain specific requirements for outdoor decking. These requirements often vary due to the climate of the region. For example, regions subject to heavy snowfall often mandate stronger structures, i.e. 60 pounds per square foot (psf) rather than 40 psf. Therefore, the construction methods and materials employed should not only satisfy industry standards but also local regulations.

Moving to another factor concerning "stick built" construction methods, often many days if not weeks of labor are required to complete assembly of a deck. Conventionally, cement footers or supports are employed on which the remainder of the deck will be supported. They must first be made and then the deck itself is constructed on those footers. As previously indicated, the nature of the site as well as the character of the construction crew will be reflected in the finished structure. Hence, the "stick built" method defies simple elegant and uniform construction. Moreover, the structural integrity and strength of such decks are subject to wide variation.

At least one problem associated with "stick built" decks has been addressed by a development in the art field, uniformity. Kits of the "Egg Crate" type are now available which are predicated on the modular concept. These kits are available for professional installation as well as in the do-it-yourself market and can reduce costs. The kits contemplate assembly of substantially uniform, square wooden platforms which are dropped into a complementary frame structure constructed at the site. Conventional methods of frame and platform construction, although lending themselves to increased uniformity when employing the aforementioned kit concepts, often fail to provide decking structures meeting BOCA strength standards and even regional regulation.

One further consideration, critical in the final evaluation of decking, is aesthetics. It is not necessary to belabor this point. Suffice it to be stated that any decking must satisfy the tastes of its owner. If the structure is unsatisfactory as an architectural compliment to the attached edifice, the landscaping or the owner's tastes, the decking will detract from rather than enhance the enjoyment of the property.

Turning to one specific example of instructions for a kit deck, Better Homes and Gardens published a book entitled Deck and Patio Projects You Can Build in 1977. On pages 42–43, a modular terraced deck structure is described. This do-it-yourself project includes treating the lumber with preservative, preparing the site, forming a frame structure on the site where the frame includes ledgers adapted to have square plywood platforms seated thereon. This deck is fashioned to rest on the ground which constitutes the support for the frame. The frame, by disclosed construction, would fail to support a deck on footers or an elevated deck..This statement is supportable as the depicted frame structure, which is conventional, would be incapable of supporting required loads due to overstress. More particularly, the frame structure requires that each cross member be notched to permit interfitting, tight assembly. The primary strength source is provided by the three $2\times10$ boards being nailed together to form the border joists along two oppositely disposed edges which lie on the ground. If the platforms are assumed to be four foot square in an eight foot span, a forty pound live load will generate over 2500 psi. Given that the stress maximum for $2\times10$ lumber is 1750 psi, the overstress on the structure and corresponding bending would exceed 40%. Thus, it would be impossible to employ the structure with supporting posts or otherwise elevate the decking.

SUMMARY OF THE INVENTION

Accordingly, it is an object of this invention to overcome the above-noted problems associated with conventional deck construction.

It is another object of this invention to provide a modular decking facilitating efficient construction and possessing sufficient strength to bear heavy loads.

Still another object of this invention is to achieve uniformity of construction and provide aesthetically pleasing or otherwise attractive structures.

Yet another object of this invention is to provide modular decking of such structural strength and integrity to meet industry standards and local regulations.

To achieve these objects, the present deck comprises: a plurality of rectangular flooring platforms; border and interior joists that intersect in criss-cross fashion to form a plurality of rectangular frames in a checkerboard-like pattern; and planks coupled to extend along the interior surface of at least two joists of each rectangular frame; each rectangular frame and the planks coupled thereto being dimensioned to enable at least one of said platforms to be seated within a corresponding frame and to be supported by the planks coupled thereto; wherein some of the joists have at least one end with a notch therein and a reinforcing truss plate associated with each notch; and wherein pairs of joists are jointed at respective intersection points thereof by positioning the notched end of a second criss-crossing joist on the plank along the first criss-crossing joist; the second joist being thereby supported by the plank of said first criss-crossing joist; and wherein each rectangular frame is dimensioned to enable preferably one square platform to be seated therein. Preferably, the planks form a four-sided ledge inscribed within each frame, a modular flooring platform—preferably square—being seated on the ledge during deck assembly. The planks thus serve two purposes: first, to support joists and, second, to support flooring platforms. This dual function of the planks permits the forming of wood-on-wood joints which allow for expansion and contraction; a four-sided ledge on which pallet-like, flooring platforms can rest, and the option of laying the pallet-like flooring platforms—when square—in any of several orientations. These and other features achieved by the invention are not realized by prior art building construction techniques, such as those found in U.S. Pat. Nos. 1,493,470 and 2,883,711.

Other objects of the invention are satisfied by a modular deck structure incorporating a plurality of rectangular flooring platforms; joists that intersect in criss-cross fashion to form a plurality of rectangular frames; planks coupled to extend along the interior surface of at least two joists of each rectangular frame; said each rectangular frame and the planks coupled thereto being dimensioned to enable at least one of said platforms to be seated within a corresponding frame and to be supported by the planks coupled thereto; wherein some of the joists have at least one end with a notch thereon; wherein pairs of joists are joined at respective intersection points thereof by positioning a notched end of a second criss-crossing joist on the plank along a first criss-crossing joist, the second joist being supported at one end by the plank of said first criss-crossing joist; and multilayer ground posts which support said rectangular frames at selected locations, each of said posts including a first layer extending from the ground up to the bottom surface of one of said joists, a second layer extending from the ground up to the bottom surface of a plank which extends along said one joist, and a third layer which extends from the ground upward and against the interior surface of the plank extending along said one joist.

Still other objects of the invention are satisfied by a method of constructing a deck structure including the steps of forming a large rectangular structure with four border joists; supporting said structure with ground posts at selected locations; inscribing the formed outer rectangular structure with planks extending along the four border joists, the planks being at a distance below the upper surfaces of the four border joists; dimensioning at least one interior joist to substantially span the distance between two opposite border joists; notching the opposite ends of each interior joist; reinforcing the notched joists; fitting one notched end of each interior joist over the plank extending along one of the two opposite border joists and fitting the other notched end over the plank extending along the other opposite border joist; and coupling a plank along each side face of each interior joist at the same level as the planks inscribing the outer rectangular structure; thereby providing a plurality of rectangular grid spaces bordered by four joists wherein each grid space has four planks inscribing the interior thereof.

In addition, the present deck and methods have an object rapid fabrication and assembly. According to the invention, a standard sized 16 foot by 12 foot deck can be fabricated at a facility in about four hours and thereafter erected in about eight hours which is intended to satisfy industry standards and regional regulation.

DESCRIPTION OF THE DRAWINGS

Figure 1:
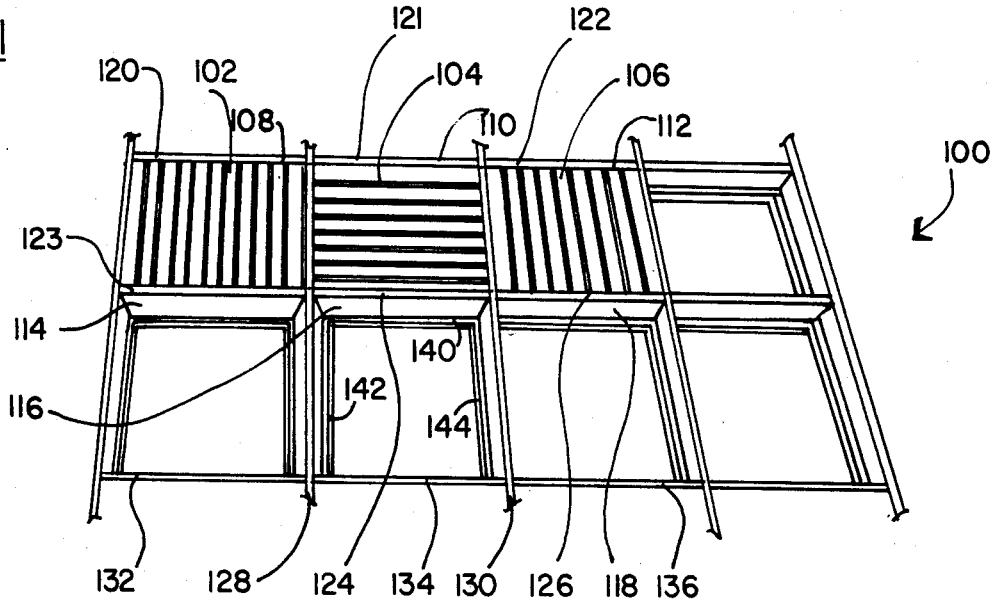
FIG. 1 is an upper front perspective view of a portion of a partially constructed deck according to the invention.

In FIG. 1, a partially constructed deck 100 is shown with three pallet-like flooring platforms 102, 104, and 106 being seated in three respective square frames (or portions thereof) 108, 110, and 112. Three additional, similar frames 114, 116, and 118 are shown enclosing square spaces into which additional platforms may be seated.

The frames 108 through 118 are defined by criss-crossing, or intersecting, joists 120 through 136 (and joists not shown). For example, the frame 110 about the platform 104 includes joists 121, 128, 124, and 130 which criss-cross, or intersect. Joists 128 and 130 extend in length several framelengths while joists 121 and 124 are positioned crosswise, e.g. orthogonally, between the joists 128 and 130 and extend one framelength.

Looking at the frame 116 defined by joists 128, 134, 130, and 124, it is noted that each of these joists has a ledge plank (see planks 140, 142, and 144) along its interior surface at a distance below the upper surface of the respective joist. For each square frame, there are four planks, the four planks providing a foursided ledge inscribing the frame. A square flooring platform (e.g. platform 104) is dimensioned to fit within a frame and rest on the planks inscribing the frame.

Figure 2:
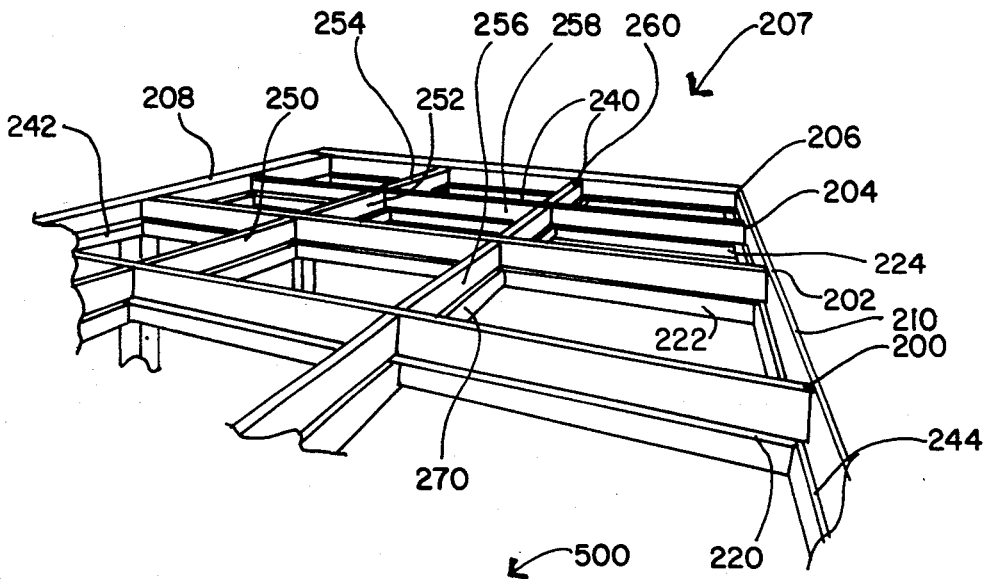
FIG. 2 is an upper back right perspective view of a partially constructed deck without any pallet-like flooring platforms being inserted.

FIG. 2 shows a first plurality of parallel interior joists 200, 202, and 204. A joist 206 represents a border joist in that it lies at the edge of the deck 207. Each joist 200 through 204 extends between two other border joists 208 and 210. Each joist 200 through 204 has a plank 220 through 224 extending along almost the entire length thereof. It is noted that on the opposite face of each joist 200 through 204 is a similar plank (not visible in FIG. 2) extending almost the entire joist length.

The border joists 206 through 210 also have planks 240 through 244, respectively, extending lengthwise along their interior faces. The interior joists 200 through 204 are notched at both ends, each notched end being seated on a plank on one of the border joists 208 or 210. Each interior joist 200 through 204 extends between the border joists 208 and 210, thereby forming a plurality of elongated four-sided grid spaces bounded on two sides by border joists and on the other two sides by interior joists. The grid spaces are, in turn, divided into frames of preferably square shape by adding orthogonal joists 250 through 260 (for example). Although not shown, each orthogonal joist 250 through 260 has a plank extending along each side face thereof. The plank on an orthogonal joist extends therealong (a) at a distance below the upper surface of the joist and (b) between planks extending along two other joists. Each orthogonal joist 250 through 260 is notched at each end so that each orthogonal joist 250 through 260 is seatable upon the planks of two other joists. For example, orthogonal joist 256 is notched at each end thereof, the first notched end sitting on the plank 222 which is coupled to extend along the interior joist 202. The other notched end of orthogonal joists 256 sits upon a plank (not shown) extending along the interior joist 100.

In examining the frame defined by joists 202, 256, 200 and 210, it is observed that four planks 222, 270, one not shown along the joist 200, and 244 form a four-sided ledge onto which a properly dimensioned flooring platform may be seated.

Figure 3:
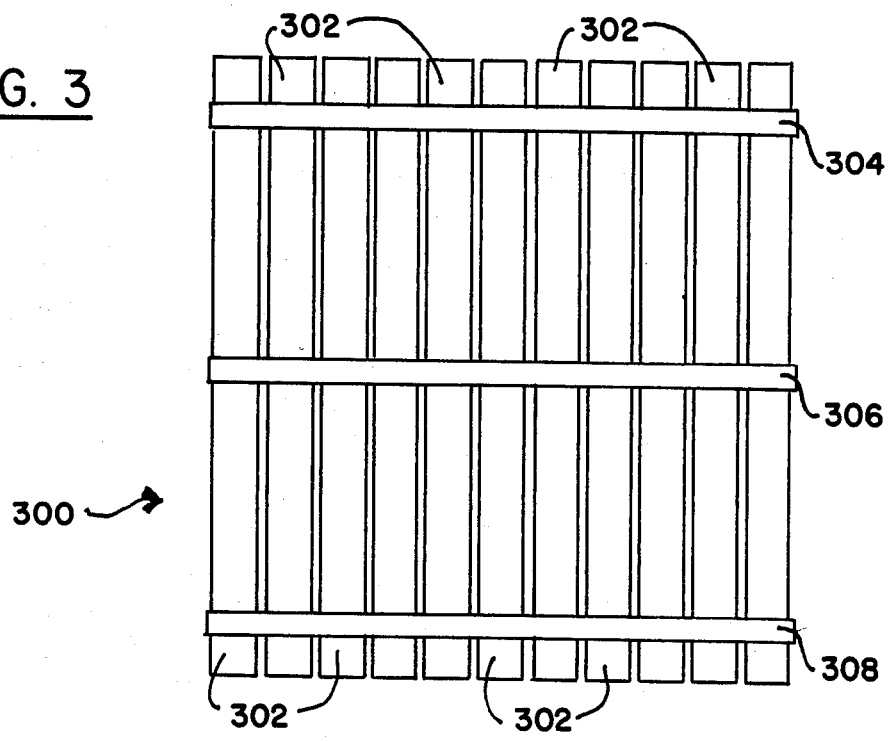
FIG. 3 is a bottom view of a pallet-like flooring platform employed in the present deck.

A sample platform 300 is shown in FIG. 3 with a bottom view thereof. The platform 300 includes a plurality of parallel slats 302 joined together by crosspieces 304, 306, and 308. The platforms (see platforms 102, 104, and 106) may be positioned with all slats parallel or with bordering platforms oriented with slats at 90° angles relative to each other—when the platforms and frames are square. The square frames with platforms inserted therein shown in FIG. 1 suggest a checkerboard-type pattern.

Figure 4:
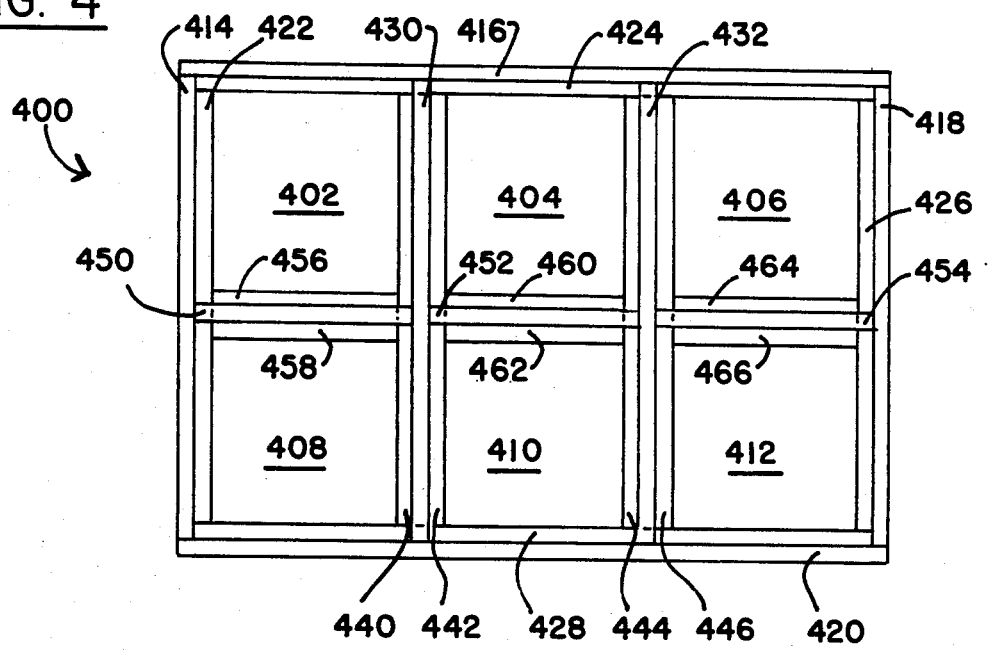
FIG. 4 is a top view of a deck structure without platforms being inserted.

Turning now to FIG. 4, a top view of a deck 400—without platforms installed—is shown. The deck 400 shows six square frames 402 through 412 (each of which extends about its respective numeral). The six frames 402 through 412 are shown to be of similar dimensions. Specifically, as described above, all frames are square and similar and the platforms seated therein are also identical. With frames (and platforms seated therein) substantially uniform in dimensions, a modular design that is easy and inexpensive to fabricate and easy to assemble, is realized. However, the present invention also contemplates non-square rectangular platforms being seatable within a similar rectangular frame. Alternatively, it is contemplated that non-rectangular platforms and frames may be employed. In such a case rhomboid platforms and frames may be employed in accordance with the invention—there then being interior joists with intersecting non-orthogonal joists extending therebetween. Although orthogonal positioning of joists is preferred, the criss-crossing angle may vary from 90 if desired.

Returning again to FIG. 4, there are illustrated four border joists 414 through 420, each of which has a plank 422 through 428, respectively, serving as a ledge therealong. The planks 422 through 428 are nailed or bolted to the respective border joist 414 through 420. Extending between the border joists 416 and 420 are two interior joists 430 and 432—each of which is notched at each end. One notched end of joists 430 and 432 sits on plank 424 with the other notched end of joists 430 and 432 sitting on plank 428.

Interior joist 430 is flanked by planks 440 and 442 fastened to each side face thereof, planks 440 and 442 extending between and at the same level as planks 424 and 428. The upper surfaces of joists 414 through 420, 430, and 432 lie in a common plane. The planks 420 through 426, 440, and 442—as well as planks 444 and 446 which flank interior joist 432—all have an upper surface in a common plane. The common plane of the planks is at a distance below the common plane of the joists. When the distance therebetween equals the height of a platform, the top surface of each platform lies in the common plane of the joist upper surfaces when the platforms are seated on the planks. The upper surfaces of the joists, together with the top surfaces of each seated platform, form a uniform flooring surface.

Also shown in FIG. 4 are orthogonal joists 450, 452, and 454. Each joist 450, 452, and 454 is notched at each end, each notched end being seated on a corresponding plank. Flanking each orthogonal joist 450, 452, and 454 and extending between the notched ends thereof are pairs of planks, 456, 458 and 460; 462 and 464, 466, respectively. These planks are coplanar with the above-mentioned planks. It is readily evident that in FIG. 4 each frame 402 through 412 is inscribed by planks onto which a platform can be seated.

As observed in the above-discussed figures, the joists meet each other with wood-on-wood joints—with a notched end of a joist resting on a plank fastened to another joist. This allows for expansion and contraction experienced by wood due to climate, temperature, and aging effects.

Figure 5:
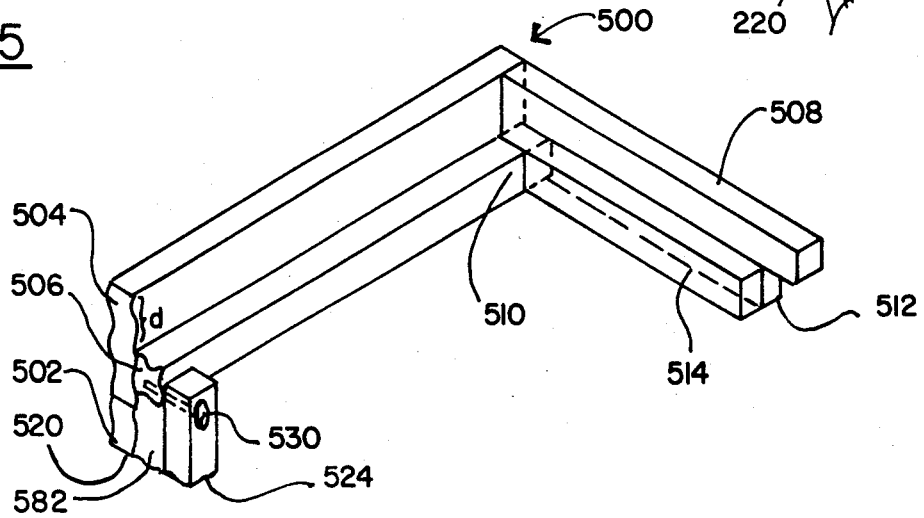
FIG. 5 is a perspective view illustrating a ground post and a wood-on-wood joint employed by the present deck where two joists meet.

In FIG. 5, a wood-on-wood joint 500 is shown in detail and a ground post 502 used in supporting the frames is shown. Looking first at the joint 500, it is noted that a border joist 504 has a plank 506 fastened along its interior surface at a distance d below the upper surface of the joist 504. A second joist 508 is shown having notches 510 and 512 cut into each end thereof. Notch 510 receives the plank 506 and joist 508 is seated on the plank 506. The joist 508 has a plank 514 coupled thereto between the two notches 510 and 512. The plank 514 is at the same height as and abuts plank 506. The joist 508 abuts joist 504 above the notches 510 and 512 and abuts the plank 506 below the notches 510 and 512. The joists 504 and 508 (and the planks thereof) meet wood-on-wood to form a joint. From the previous description, it will be observed that a platform (not shown) of height d is seatable upon the planks 506 and 514—the top surface of the platform being coplanar with the upper surface of joists 504 and 508.

In FIG. 5, the joists 504 and 508 are shown extending below the respective planks 506 and 514. If desired, the bottom surfaces of the joists 504 and 508 may be flush with the bottom surfaces of the planks 506 and 514.

Referring now to the ground post 502 of FIG. 5, the post 502 includes three layers 520, 522, and 524 coupled together. The layers 520 through 524 may be coupled by any of various known wood fastening techniques—including but not limited to nails or bolts. The layer 520 extends from the ground upward and against the bottom surface of the joist 504. Layer 522 extends from the ground upward and against the bottom surface of the plank 506. A fastener 530 extends through the third layer 524 and into the plank 506. A plurality of ground posts, like post 502, are positioned to support the frames above the ground.

In accordance with the invention, the wood employed is of proper load-bearing dimensions and characteristics known to those in the art. Moreover, it is preferred that the wood be "Wolmanized", a trademark of Koppers Company, Inc., for treated lumber.

Also according to the invention, although it is preferred that the top surface of the flooring platforms be coplanar with the upper surfaces of the joists, this is not required. The platforms may be higher than the joists if desired. Similarly, although preferably four-sided to inscribe the interior of a frame, the ledge planks may also be positioned along only two or three joists. For example, the planks 456 through 466 may be deleted. In any case, at least one pair of planks along opposite joists should be provided to assure good support for a platform. Further, although one platform in each frame is preferred, it is also contemplated that more than one platform may be supported by a ledge plank of a given frame.

A deck providing for a 60 pound per square foot live load would employ the structural design described above with certain construction enhancements. More particularly, the supporting posts would be located every eight (8)feet parallel to the edifice wall from which the deck projects, and every twelve (12) feet of projection. The posts are set in a factory precast, 8×12 inch concrete footers set on a two inch slag base. As generally described above (see FIG. 5), each post is comprised of three 2×4 inch pieces nailed together by two, three inch nails spaced every eight inches, on center. The posts are connected to the frame with a four inch lag bolt and four nails.

Turning now to the joists and planks in the 60 pound model, they are nailed together with two, three inch screw shank nails every eight inches on center. Each joist to joist connection (see FIG. 5) is secured by toe nailing eight three inch nails into each connecting beam. The border joist interfacing with and connecting the main frame to an edifice is structured no differently but its connection is more detailed. First, if the junction involves masonry, it is recommended that it be drilled and lead shields be used. Otherwise, for this connection, a combination of four inch and six inch zinc plated lag bolts are employed. Penetration of from 1¾ to 3 inches into the edifice wall is desired. The four inch lags are positioned every 24 inches, on center, and while the six inch lags positioned every 48 inches on center secure the plank and joist secure the border joist.

Figure 6:
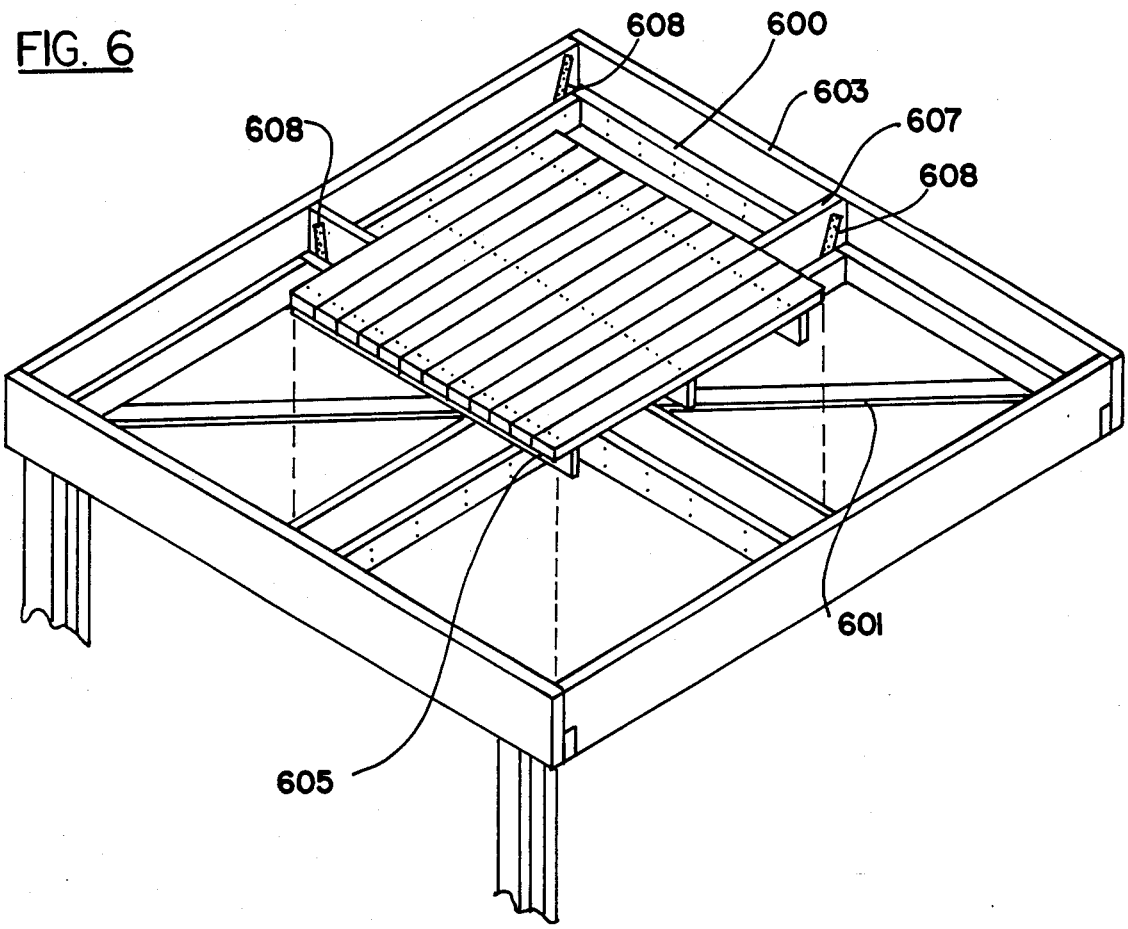
FIG. 6 is a perspective view of an alternative embodiment of the invention.

Turning now to FIG. 6, the illustrated structural additions further include the incorporation of wind braces 601 extending beneath the platform and diagonally from the edifice border and border joist 603. These braces are nailed to the underside of each overlapping joist thereby not interfering with the recessing of platform 605 within frame 600.

Figure 7:
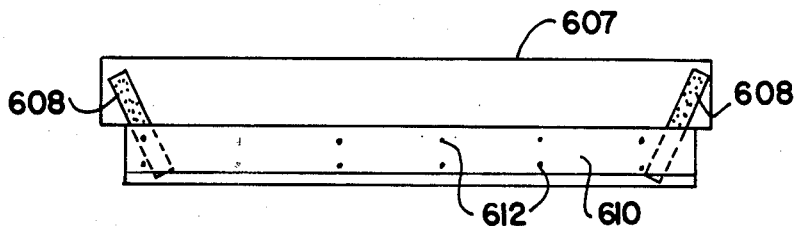
FIG. 7 is a front view of an interior joist of the alternative embodiment.

Probably the least noticed, but numbering among the more significant features of the 60 pound structure is the addition of galvanized truss plates 608. Truss plates 608 are better illustrated as applied to notched interior joist 607 in FIG. 7.

Truss plates 608 are 2×8 inch 20 guage zinc coated steel such as those available from the Panel Clip Company of Farmington, Michigan, sold under the name "Series III Truss Clips" and otherwise are commercially available. Each plate has multiple rows of teeth in a staggered arrangement and is rated at approximately 225 pounds per square inch. Plates 608 are applied to notched joist 607 with a fifty ton press at a minimum of 800 pounds per square inch pressure. The techniques involved are generally conventional and, therefore, there is no need for elaboration. However, the geometry of application is important in order to maximize strength enhancement of notched joist 607 relative to its wood/wood intersection with a connecting joist. It has been determined that truss plates 608 should extend just across the top of the notch (approximately a quarter of an inch) at an angle of 60°. One truss plate should be applied on each side of the notch. Once applied to joist 607, plank 610 is nailed to joist 607 with screw shank nails 612 every eight inches on center. This technique results in a doubling of the shear reaction at the joist intersection which contributes to the remarkable strength and structural integrity afforded by this embodiment of the instant invention.

The deck of the present invention thus provides for various embodiments wherein frames (with interior ledges therealong) support flooring platforms in a checkerboard-type pattern wherein the design is preferably modular and easily assembled.

Stairs and deck railing may be provided in accordance with techniques known in the art.

Other improvements, modifications, and embodiments will become apparent to one of ordinary skill in the art upon review of this disclosure. Such improvements, modifications and embodiments are considered to be within the scope of this invention as defined by the following claims.

I claim:

1. A modular structure comprising:

a plurality of rectangular flooring platforms;

border and interior joists that intersect in criss-cross fashion to from a plurality of rectangular frames where the border joists include a first and a second pair of spaced periometer joists, the first pair being unnotched and the second pair being notched only on the ends of the joists; and planks coupled to extend along the interior surface of at least two joists of each rectangular frame;

said each rectangular frame and the planks coupled thereto being dimensioned to enable at least one of said platforms to be seated within a corresponding frame and to be supported by the plants coupled thereto;

wherein said interior joists have at least one end with a notch therein; and wherein pairs of joists are joined at respective intersection points thereof by positioning a notched end of a second criss-crossing joist on the plank along a first criss-crossing joist, the second joist being supported at one end by the plank of said first criss-crossing joist.

2. A modular deck structure according to claim 1, wherein each rectangular frame is dimensioned to enable only one of said platforms to be seated therein;

said platforms inserted in said respective frames forming a checkerboard-like pattern.

3. A modular deck structure according to claim 2, wherein said planks comprise four planks for each rectangular frame; said four planks for each rectangular frame forming a four-sided ledge inscribing said each rectangular frame at a distance below the upper surfaces of the joists thereof;

a platform being seatable within each frame and upon the ledge inscribing said each frame.

4. A modular deck structure according to claim 3, wherein each platform has a height substantially equal to the distance between (a) the upper surfaces of the joists of the rectangular frame into which said each platform is seatable; and (b) the ledge inscribing the rectangular frame into which said each platform is seatable;

the seating of the platform in the rectangular frames providing a flooring that includes the top surface of the platforms and the upper surfaces of said joists.

5. A modular deck structure according to claim 4, further comprising:

multilayer ground posts which support said rectangular frames at selected locations, each post comprising:

a first layer extending from the ground up to the bottom surface of one of said joists;

a second layer extending from the ground up to the bottom surface of a plank which extends along said one joist; and a third layer which extends from the ground upward and against the interior surface of the plank extending along said one joist;

said three layers being held together.

6. A modular deck structure according to claim 5 further comprising:

coupling means, extending through the third layer and at least into the plank, along said one joist, fixedly positioning said one joist and the plank therealong relative to said corresponding ground post, and diagonally disposed wind braces.

7. A modular deck structure according to claim 6 wherein all platforms are substantially uniform modules dimensioned substantially uniformly.

8. A modular deck structure according to claim 7 wherein each platform module is substantially square and each rectangular frame is substantially square.

9. A modular deck structure comprising:

a plurality of rectangular flooring platforms;

joists that intersect in criss-cross fashion to form a plurality of rectangular frames;

planks coupled to extend along the interior surface of at least two joists of each rectangular frame;

said each rectangular frame and the planks coupled thereto being dimensioned to enable at least one of said platforms to be seated within a corresponding frame and to be supported by the planks coupled thereto;

wherein some of the joists have at least one end with a notch thereon;

wherein pairs of joists are joined at respective intersection points thereof by positioning a notched end of a second criss-crossing joist on the plank along a first criss-crossing joist, the second joist being supported at one end by the plank of said first criss-crossing joist; and multilayer ground posts which support said rectangular frames at selected locations, each of said posts including a first layer extending from the ground up to the bottom surface of one of said joists, a second layer extending from the ground up to the bottom surface of a plank which extends along said one joist, and a third layer which extends from the ground upward and against the interior surface of the plank extending along said one joist.

10. A modular deck structure comprising:

a four-sided frame including:

(a) a first joist and a second joist substantially parallel to each other and both being unnotched; and (b) a third joist and a fourth joist substantially parallel to each other, said third joist and said fourth joist each extending between said first joist and said second joist and each having a notch at each end thereof and each notch including a reinforcing truss means proximate thereto; and a first plank extending along said first joist below the upper surface thereof and a second plank extending along said second joist below the upper surface thereof, said first plank and said second plank serving as an interior ledge for said frame;

each notched ends of said third joist and said fourth joist resting on said first plank and said second plank, thereby supporting said third joist and fourth joist.

11. A modular deck structure according to claim 10 wherein the upper surfaces of the four joists in said frame lie in a common plane.

12. A modular deck structure according to claim 11 further comprising:

a flooring platform seated within said frame and supported by said planks.

13. A modular deck structure according to claim 12, wherein said platform is dimensioned in height so that the upper surface of said platform lies in the common plane of the upper surfaces of the joists.

14. A modular deck structure according to claim 13, further comprising:

a third plank extending along the interior face of said third joist and a fourth plank extending along the interior face of said fourth joist;

said four planks thereby inscribing said frame with a four-sided ledge upon which said platform is supported.

15. A modular deck structure further comprising:

a plurality of frames as set forth in claim 10 to form a checkerboard-like structure of frames, adjacent frames sharing the joist therebetween.

16. A modular deck structure further comprising:

a plurality of frames and platforms as set forth in claim 14 to form a checkerboard-like structure of frames, adjacent frames sharing the joist therebetween.

17. A modular deck structure comprising:

a four-sided frame including:

(a) a first joist and a second joist substantially parallel to each other both said first and second joists having continuous cross-sectional configurations along their entire respective lengths;

(b) a third joist and a fourth joist substantially parallel to each other, said third joist and said fourth joist each extending between said first joist and said second joist and each having a notch at each end thereof;

a first plank extending along said first joist below the upper surface thereof and a second plank extending along said second joist below the upper surface thereof, said first plank and said second plank serving as an interior ledge for said frame;

each notched ends of said third joist and said fourth joist resting on said first plank and said second plank, thereby supporting said third joist and front joist; and ground posts which support said frames at selected locations, each post.

18. A modular deck structure according to claim 17 wherein said ground posts include a first layer extending from the ground up to the bottom surface of a plank which extends along said one joist; a second layer extending from the ground up to the bottom surface of a plank which extends along said one joist; and a third layer which extends from the ground upward and against the interior surface of the plank extending along said one joist; said three layers being held together.

19. A modular structure comprising:

a plurality of rectangular flooring platforms;

sets of borer and interior joists that intersect in criss-cross fashion to form a plurality of rectangular frames where at least one set of border joists is unnotched, point supports for elevating said border joists above the underlying surface where discrete portions of said joists rest on said point supports; and planks coupled to extend along the interior surface of at least two joists of each rectangular frame;

said each rectangular frame and the planks coupled thereto being dimensioned to enable at least one of said platforms to be seated within a corresponding frame and to be supported by the planks coupled thereto;

wherein said interior joists have at least one end with a notch therein and a reinforcing truss plate means associated with each notch; and wherein pairs of joists are joined at respective intersection points thereof by positioning a notched end of a second criss-crossing joist on the plank along a first criss-crossing joist, the second joist being supported at one end by the plank of said first criss-crossing joist.

20. A modular structure comprising:

a plurality of rectangular flooring platforms;

border and interior joists that intersect in criss-cross fashion to form a plurality of rectangular frames; and planks coupled to extend along the interior surface of at least two joists of each rectangular frame;

said each rectangular frame and the planks coupled thereto being dimensioned to enable at least one of said platforms to be seated within a corresponding frame and to be supported by the planks coupled thereto;

multilayer ground posts which support said rectangular frames at selected locations, where each post includes a first layer extending from the ground up to the bottom surface of one of said joists; a second layer extending from the ground up to the bottom surface of a plank which extends along said one joist; and a third layer which extends from the ground upward and against the interior surface of the plank extending along said one joist, where the three layers are held together;

wherein said interior joists have at least one end with a notch therein and a reinforcing truss plate means associated with each notch; and wherein pairs of joists are joined at respective intersection points thereof by positioning a notched end of a second criss-crossing joist on the plank along a first criss-crossing joist, the second joist being supported at one end by the plank of said first criss-crossing joist.

* * * * *